US005163182A

United States Patent [19]

Fiveash

[11] Patent Number: 5,163,182

[45] Date of Patent: Nov. 17, 1992

[54] JUMPSUIT WITH CONCEALED DROPSEAT

[76] Inventor: Sara G. Fiveash, 2550 Stongate Dr., Tallahassee, Fla. 32308

[21] Appl. No.: 823,384

[22] Filed: Jan. 21, 1992

[51] Int. Cl.[5] ..... A41D 1/06

[52] U.S. Cl. ..... 2/79; 2/75; 2/76; 2/80; 2/83; 2/227; 2/237; 2/221; 2/DIG. 7

[58] Field of Search ..... 2/79, 75, 76, 80, 83, 2/227, 228, DIG. 7, 237, 221, 78 R, 78 A, 78 B, 78 C, 78 D, 77

[56] References Cited

U.S. PATENT DOCUMENTS

| | | | |
|---|---|---|---|
| 1,945,747 | 2/1934 | Martin | 2/79 |
| 2,357,532 | 9/1944 | Menzin | 2/79 |
| 3,088,116 | 5/1963 | Simonoff | 2/79 |
| 3,852,824 | 12/1974 | Grey | 2/79 |
| 3,949,427 | 4/1976 | Sampey | 2/79 |
| 3,994,026 | 11/1976 | Sampey | 2/79 |
| 4,139,913 | 2/1979 | Garin et al. | 2/221 |
| 4,457,025 | 7/1984 | Meryash | 2/79 |
| 4,535,480 | 8/1985 | Kunieda | 2/79 |
| 4,941,209 | 7/1990 | George | 2/79 |
| 5,014,356 | 5/1991 | Thomasi-Dubois | 2/79 |

*Primary Examiner*—Werner H. Schroeder
*Assistant Examiner*—Gloria Hale
*Attorney, Agent, or Firm*—Kelly O. Corley

[57] ABSTRACT

A jumpsuit with a dropseat panel concealed by a folded pocket panel. When the dropseat is opened, the upper free edge of the pocket has a length selected such that it controls movement of the dropseat panel and its attached waistband, maintaining the waistband in contact with the wearer's body whereby the waistband cannot fall into a toilet.

3 Claims, 1 Drawing Sheet

JUMPSUIT WITH CONCEALED DROPSEAT

The invention related to a jumpsuit having a concealed dropseat panel, and more particularly to such a jumpseat wherein movement of the panel is controlled when the dropseat is lowered.

Several designs are known to have been suggested for jumpsuits having concealed dropseats. All such known designs suffer from the disadvantage that the dropseat panel is permitted to hang freely when the panel is lowered. This could permit the panel to become wetted or soiled when the wearer uses the toilet.

These and other difficulties with prior art designs are avoided by the present invention, which provides an improved jumpseat wherein the movement of the panel is controlled.

According to a first primary aspect of the invention, there is provided an improved jumpsuit comprising a bodice having a waist front and a shirttail that extends below the waist front, and pants having a front portion attached to the waist front and depending from the bodice, and a dropseat panel having an upper waistband and a side edge intersecting at a corner, the dropseat panel forming the back portion of the pants. The front portion has a lateral edge at the side of the pants adjacent the side edge when the dropseat panel is closed. Fastening means are provided for releasably attaching the corner to the lateral edge to close the dropseat panel. Folding means form a pocket when the dropseat panel is closed, the folding means comprising an edge integral with the lateral edge, an edge integral with the side edge, and an upper free edge extending from the corner to the lateral edge. The upper free edge has a length selected such that when the fastening means is released and the dropseat panel is lowered to an open position, the waistband is guided and constrained by the upper free edge to successively hug the wearer's gluteus maximus and biceps flexor cruris regions, whereby the waistband is prevented from falling into a toilet.

According to another aspect of the invention, the waistband contains elastic.

According to another aspect of the invention, the fastening means comprises a button and mating buttonhole.

Other aspects will in part appear hereinafter and will in part be apparent from the following detailed description taken together with the accompanying drawings, wherein.

Figure 1:
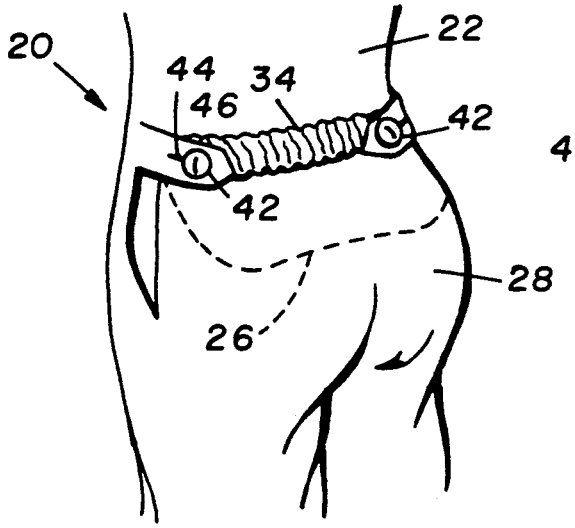
FIG. 1 is an isometric view of the left rear quarter of a jumpsuit according to the invention, with the dropseat closed.

With reference to the several figures, the invention is a jumpsuit 20 for a wearer, the jumpsuit comprising bodice 22 having a waistfront 24 (FIG. 4) and shirttail 26 that extends below waistfront 24.

Jumpsuit 20 further comprises pants 28 having front portion 30 (FIG. 4) attached to waist front 24 and depending from bodice 22. The back portion of pants 28 is formed by dropseat panel 32 (FIG. 3), which comprises upper waistband 34 and side edge 36 intersecting at corner 38. When dropseat panel 32 is closed as illustrated in FIG. 1, side edge 36 lies adjacent lateral edge 40 of front portion 30.

Fastening means are provided for releasably attaching corner 38 to lateral edge 40, this being illustrated as button 42 mounted on corner 38 and a mating buttonhole 44. While buttonhole 44 is illustrated as formed in rearwardly extending tab 46, tab 46 could be eliminated and buttonhole 44 could be formed in the fabric constituting lateral edge 40 if desired.

Folding means 48 is provided to form a pocket when dropseat panel 32 is closed. Folding means 48 comprises edge 50 integral with lateral edge 40, edge 52 integral with side edge 36, and upper free edge 54 (FIG. 3) extending from corner 38 to lateral edge 40.

Figure 2:
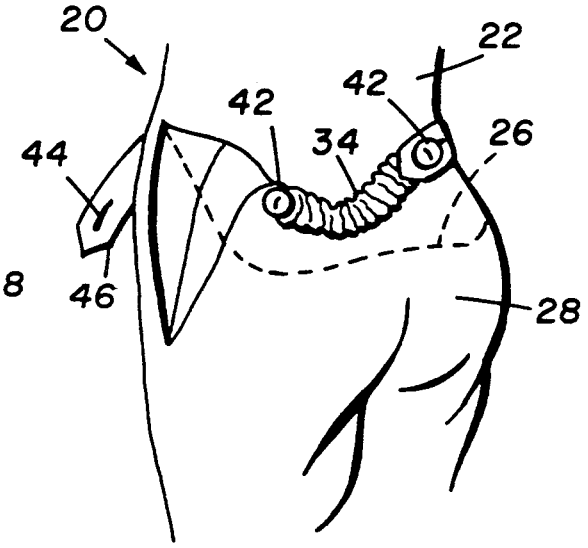
FIG. 2 is a similar view, with the fasteners of the dropseat released.
Figure 3:
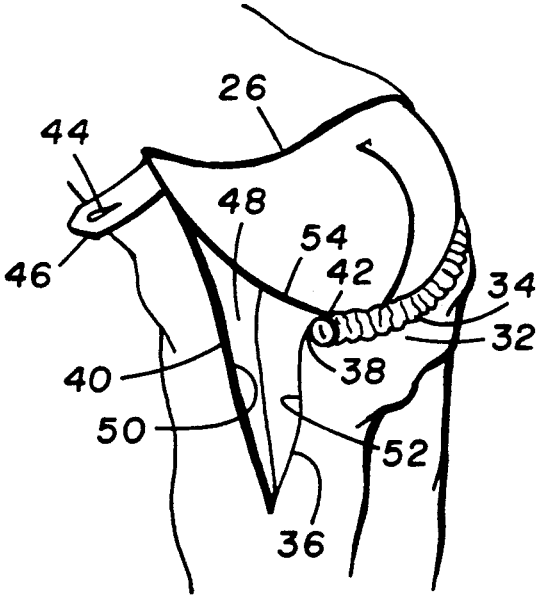
FIG. 3 is a similar view wherein the wearer has exerted downward pressure on the waistband.
Figure 4:
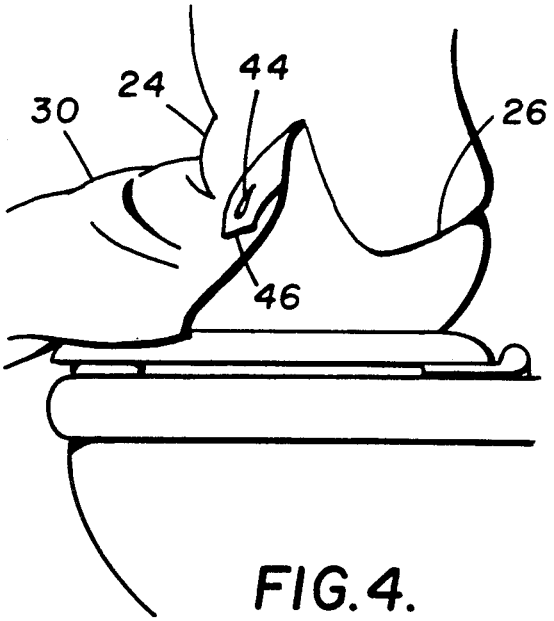
FIG. 4 is a view of the dropseat fully lowered to the open position.

According to the invention, upper free edge 54 has a length selected such that when button 42 is released from buttonhole 44 and dropseat panel 32 is lowered from the closed position illustrated in FIG. 1 through the intermediate positions shown in FIGS. 2 and 3 to the open position shown in FIG. 4, waistband 34 is guided and restrained by upper free edge 54 to successively hug the wearer's gluteus maximus and biceps flexor cruris regions whereby waistband 34 cannot fall into a toilet.

Waistband 34 preferably contains elastic in order to more readily stretch and contract so as to conform to the wearer's body during the shifting between open and closed positions of dropseat 32. When in the closed position, the fact that dropseat 32 can be lowered is effectively concealed by folding pocket means 48, which appears to be a normal pocket.

It will be understood that, while the description has been directed to the left side of the garment, the right side has the same construction.

I claim:

1. In a jumpsuit for a wearer comprising a bodice having a waist front and a shirttail that extends below said waist front, and pants having a side and having a front portion attached to said waist front and depending from said bodice, the improvement comprising:

(a) a dropseat panel having an upper waistband and a side edge intersecting at a corner, said dropseat panel forming a back portion of said pants;

(b) said front portion having a lateral edge at the side of said pants adjacent said side edge when said dropseat panel is closed;

(c) fastening means for releasably attaching said corner to said lateral edge to close said dropseat panel;

(d) folding means forming a pocket when said dropseat panel is closed, said folding means comprising an edge integral with said lateral edge, an edge integral with said side edge, and an upper free edge extending from said corner to said lateral edge;

(e) said upper free edge having a length selected such that when said fastening means is released and said dropseat panel is lowered to an open position, said waistband is guided and restrained by said upper free edge to successively hug said wearer's gluteus maximus and biceps flexor cruris regions, whereby said waistband is prevented from falling into a toilet.

2. The jumpsuit defined in claim 1, wherein said waistband contains elastic.

3. The jumpsuit defined in claim 1, wherein said fastening means comprises a button and mating buttonhole.

* * * * *